US010512318B2

(12) United States Patent
McKelvey

(10) Patent No.: US 10,512,318 B2
(45) Date of Patent: Dec. 24, 2019

(54) LUGGAGE WARDROBE SYSTEM AND METHOD OF USE

(71) Applicant: Sanni McKelvey, Lee's Summit, MO (US)

(72) Inventor: Sanni McKelvey, Lee's Summit, MO (US)

( * ) Notice: Subject to any disclaimer, the term of this patent is extended or adjusted under 35 U.S.C. 154(b) by 0 days.

(21) Appl. No.: 15/946,138

(22) Filed: Apr. 5, 2018

(65) Prior Publication Data

US 2018/0289127 A1 Oct. 11, 2018

Related U.S. Application Data

(60) Provisional application No. 62/481,746, filed on Apr. 5, 2017.

(51) Int. Cl.

| | |
|---|---|
| ***A45C 13/28*** | (2006.01) |
| ***A45C 13/26*** | (2006.01) |
| ***A45C 9/00*** | (2006.01) |
| ***A45C 13/00*** | (2006.01) |
| ***A45C 5/03*** | (2006.01) |

(52) U.S. Cl.

CPC ..... *A45C 13/28* (2013.01); *A45C 5/03* (2013.01); *A45C 9/00* (2013.01); *A45C 13/001* (2013.01); *A45C 13/262* (2013.01); *A45C 2013/267* (2013.01)

(58) Field of Classification Search

CPC ..... A45C 13/262; A45C 13/267; A45C 2013/267; A45C 13/28; A47G 25/1457; A47B 61/06

USPC ..... 190/102, 115, 13 R; 206/279

See application file for complete search history.

(56) References Cited

U.S. PATENT DOCUMENTS

| | | | | |
|---|---|---|---|---|
| 139,420 A | | 5/1873 | Payne | |
| 915,507 A | | 3/1909 | Thomas | |
| 930,343 A | | 8/1909 | Bonsall | |
| 2,639,793 A | | 5/1953 | Hellman | |
| 3,144,946 A | | 8/1964 | Ellis | |
| 4,245,763 A | * | 1/1981 | Weinberg | A47G 25/1457 294/143 |
| 4,267,905 A | | 5/1981 | Stewart | |
| 4,296,959 A | * | 10/1981 | Helbig | A47G 25/1457 211/118 |
| 4,772,133 A | * | 9/1988 | Volk | B65D 33/1633 294/137 |
| 4,982,820 A | | 1/1991 | Scott | |
| 5,292,565 A | | 3/1994 | Napier et al. | |
| 5,306,063 A | * | 4/1994 | Higgins | A45F 5/10 294/143 |

(Continued)

FOREIGN PATENT DOCUMENTS

| | | | | |
|---|---|---|---|---|
| CA | 2081301 A1 | * | 4/1994 | A47B 61/003 |
| WO | WO-2007019379 A2 | * | 2/2007 | A45C 13/28 |

*Primary Examiner* — Sue A Weaver

(74) *Attorney, Agent, or Firm* — Law Office of Mark Brown, LLC; Christopher M. DeBacker

(57) ABSTRACT

A luggage system having a removable decorative storage crown for receiving and temporarily storing clothing items, such as suit jackets, uniforms, costumes, or other items using the same device that is used as a pull-handle. A stand element can be unfolded from the base of the luggage to act as a support, preventing the device from tipping when in a clothing rack orientation, but which can simply fold away when the luggage is being transported.

18 Claims, 4 Drawing Sheets

(56) References Cited

U.S. PATENT DOCUMENTS 5,379,870 A 1/1995 Sadow
5,582,334 A * 12/1996 Blazer ..... A47G 25/60 223/85
5,876,009 A * 3/1999 Simoncioni, Jr. ..... A47G 25/0614 211/88.01
6,053,378 A * 4/2000 Doyel ..... A47G 25/60 211/113
6,119,835 A 9/2000 Lin
6,129,254 A 10/2000 Yu
6,264,047 B1 7/2001 Crumley
6,338,180 B1 * 1/2002 Massard ..... A45C 13/26 16/110.1
6,481,574 B1 11/2002 Pakosh
7,143,902 B2 12/2006 Iverson et al.
7,232,169 B2 * 6/2007 Porter ..... A45F 5/1026 294/137
7,607,535 B2 10/2009 Jackson
8,490,764 B2 7/2013 Simester
8,714,369 B2 5/2014 Liu et al.
9,101,187 B2 8/2015 Zheng
9,622,597 B2 4/2017 White
2006/0249550 A1 * 11/2006 Giampavolo ..... A47G 25/1457 223/85
2007/0089952 A1 4/2007 Herbst et al.
2007/0256994 A1 11/2007 Jackson
2007/0295570 A1 12/2007 Campbell et al.
2008/0237279 A1 * 10/2008 Lueth ..... A47G 25/20 223/88
2009/0000894 A1 1/2009 Middup
2009/0321204 A1 12/2009 Barkow
2011/0120826 A1 5/2011 Middup
2016/0022032 A1 * 1/2016 Simon ..... A45C 13/28 108/42
2017/0071302 A1 * 3/2017 McKelvey ..... A45C 9/00

* cited by examiner

LUGGAGE WARDROBE SYSTEM AND METHOD OF USE

CROSS-REFERENCE TO RELATED APPLICATION

This application claims priority in U.S. Provisional Patent Application No. 62/481,746 Filed Apr. 5, 2017, which is incorporated herein by reference.

BACKGROUND OF THE INVENTION

1. Field of the Invention

The present invention relates generally to a hanging rack and luggage system and method for use thereof, and more specifically to a luggage system with a removable decorative storage crown and support stand.

2. Description of the Related Art

Dancers, performers, travelers, or anyone else often need to quickly change clothing or costumes in public places. Typical luggage requires the user to sift through piles of clothing to find the correct article. Existing luggage with wardrobe attachments require a wardrobe bar to extend from the storage compartment of the luggage, rendering the luggage unable to close while the wardrobe feature is in use. Further, these wardrobe features are typically made to be as lightweight and cheaply as possible, typically having a single structural post extending away from the luggage on either side of the crossbar and lack any kind of structural support.

Heretofore there has not been available a luggage wardrobe system or method of use with the advantages and features of the present invention.

BRIEF SUMMARY OF THE INVENTION

The present invention generally provides a luggage system including a removable decorative storage crown for receiving and temporarily storing clothing items, such as suit jackets, uniforms, costumes, or other items using the same device that is used as a pull-handle. A stand element can be unfolded from the base of the luggage to act as a support, preventing the device from tipping when in a clothing rack orientation, but which can simply fold away when the luggage is being transported.

The present invention may be used in conjunction with luggage wardrobe systems such as the systems disclosed by U.S. patent application Ser. No. 14/976,963 Filed Dec. 21, 2015, now U.S. Pat. No. 9,820,542, and U.S. patent application Ser. No. 15/820,164 filed Nov. 21, 2017, a continuation-in-part thereof, both of which are owned by the Applicant of the present application and which are incorporated herein by reference.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
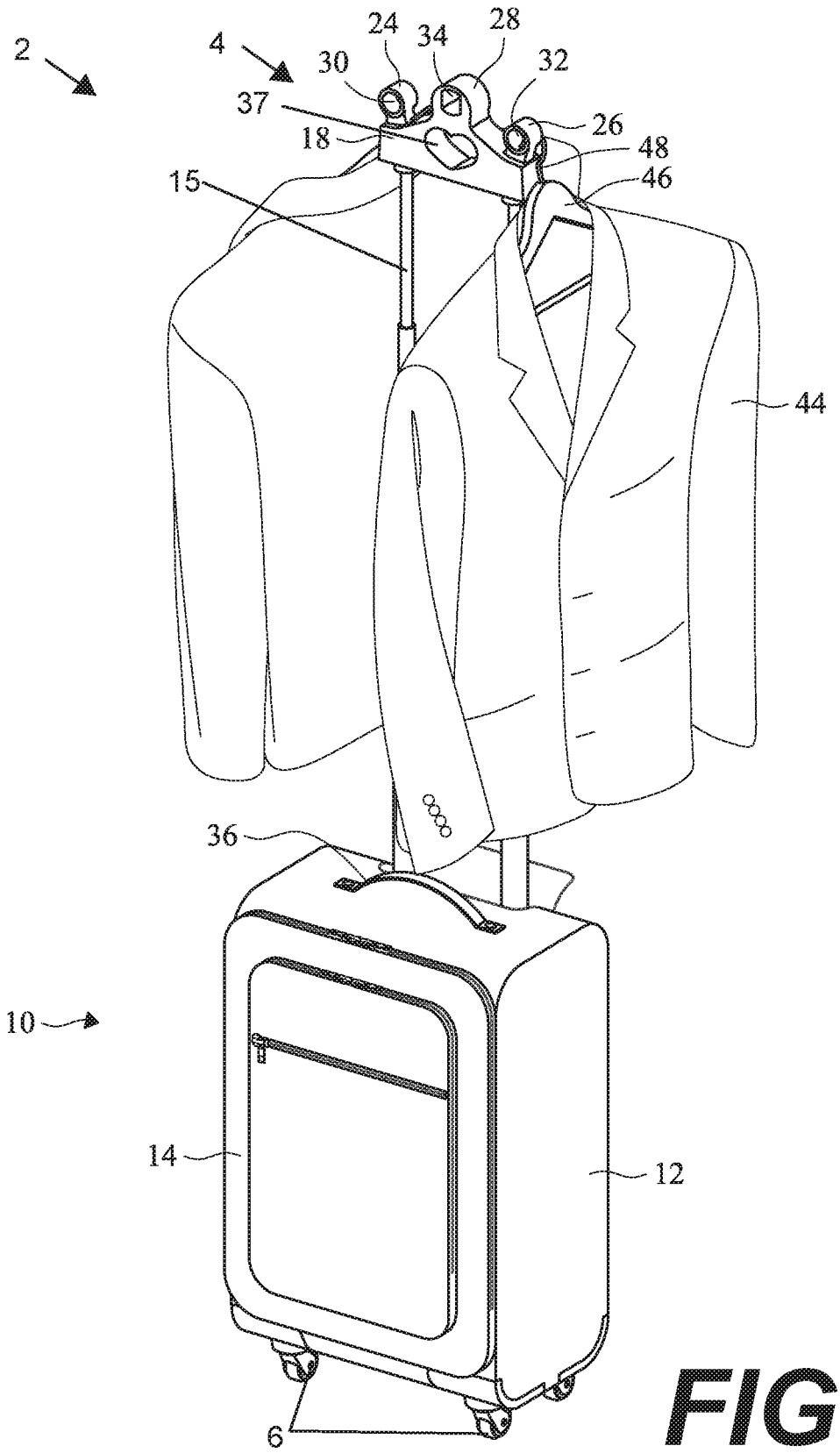
FIG. 1 is a three-dimensional isometric frontal view of a preferred embodiment of the present invention in a wardrobe storage orientation.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Luggage Wardrobe System 2

The present invention provides a piece of luggage 10 which includes at least one handle 20 and a telescoping tow bar 15 for towing the luggage along the ground using caster wheels. The luggage may have a second handle 36 for when the first handle 20 and tow bar 15 are stored. The luggage 10 also contains zippable compartments 14 and structural sidewalls 12 as is common in such luggage. A preferred embodiment of luggage 10 includes four wheels 6 or casters but could be constructed with only two wheels. As is typical with these types of luggage, the tow bar allows the user to easily tow the luggage 10 behind them using the tow bar and casters.

Figure 2:
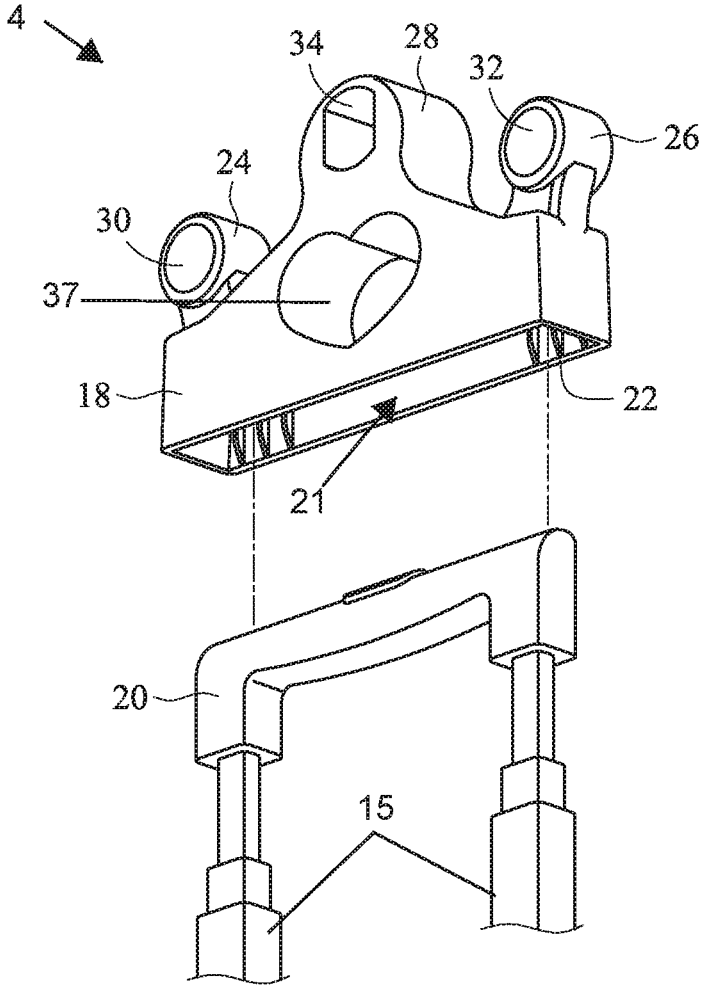
FIG. 2 is a detailed exploded isometric view showing a decorative storage crown element being connected to the end of a pull handle element.
Figure 3:
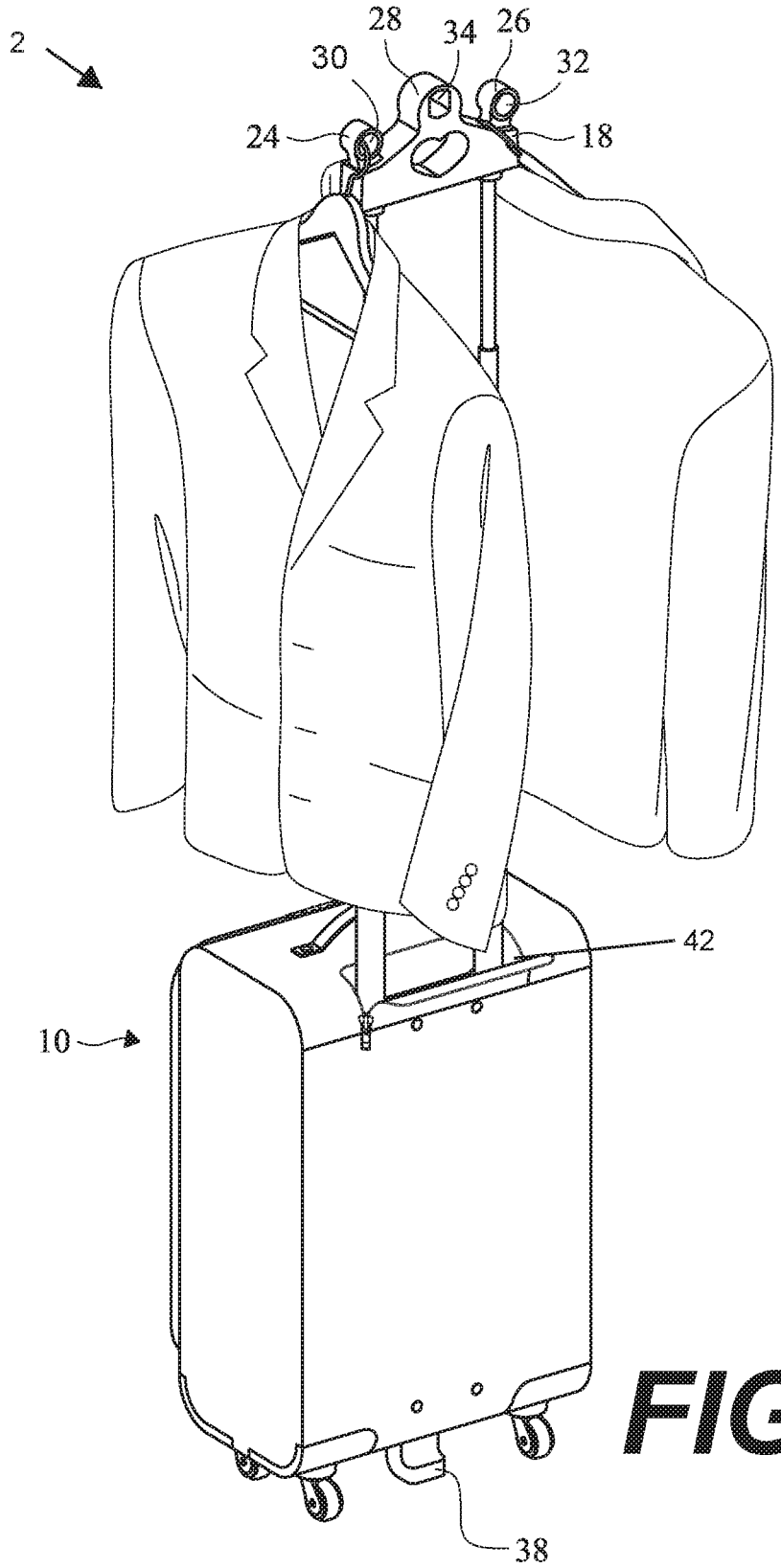
FIG. 3 is another three-dimensional isometric view of the embodiment of FIG. 1 from a rear angle.
Figure 4:
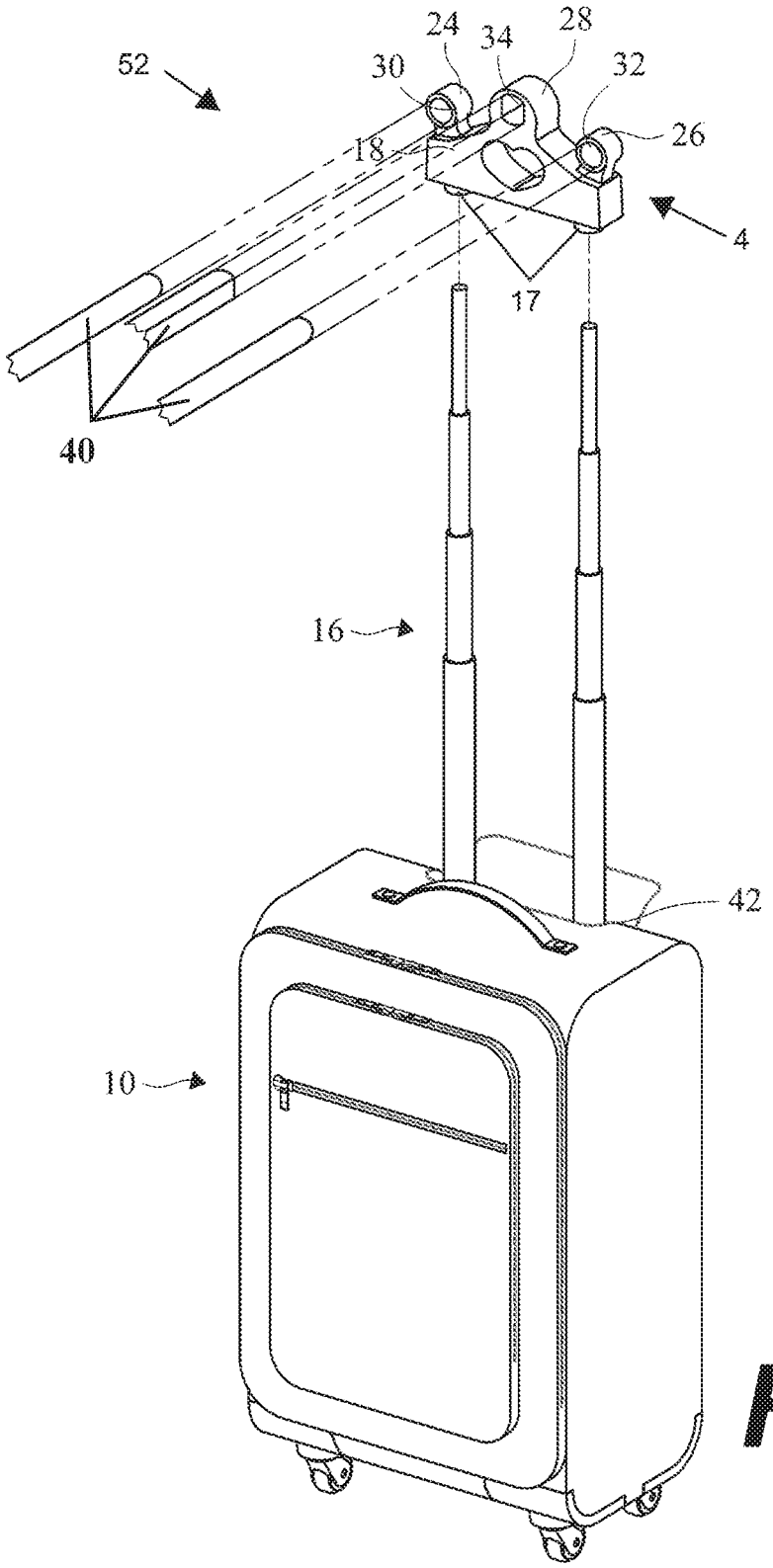
FIG. 4 is a three-dimensional isometric view of a slightly alternative embodiment thereof.

The luggage 10 can be transformed into an upright wardrobe storage system by flipping out a structural stand 38 on the base of the luggage 10, as shown in FIG. 2, thereby preventing the luggage element from tipping over. The tow bar 15 is extended to its full height and a removable decorative storage crown 4 is placed upon the handle 20. The semi-universal storage crown 4 body 18 fits over the top handle 20 of the tow bar 15 and includes a pair of hanger receiver elements 24, 26 on either side of the crown, along with a decorative central opening 28 which can accommodate more hangers 46 holding garments 44. The hanger 46 hooks 48 loop into the openings 30, 32 of the receivers 24, 26, or may hook around the outside of the receivers. Two such luggage wardrobe systems placed in proximity could support a wardrobe bar 40 between the two by slotting the bar into one of the openings 30, 32, 34 in the crown's receiver elements as shown in FIG. 4, allowing for much more clothing capacity. The center opening 34 may be differently shaped, as shown in FIG. 2, which includes a curved top edge, curved bottom edge, and straight side edges.

The storage crown 4, as stated above, is somewhat universal and should fit on the top of most standard luggage tow handles 20. A recess 21 in the base of the crown receives the top-most handle portion of the tow handle and provides several places for receiving clothing hangers and other hanging implements for temporary storage. FIG. 2 shows how this interaction occurs in more detail. Fins 22 within the crown 4 provide a snug fit over the handle 20 portion of the tow handle. The two side receivers 24, 26 can receive clothing hangers, and each may include openings 30, 32 for receiving hangers or for potentially placing a rod between two such crowns 4 for a larger area for hanging clothing and other items as described above. A top knob 28 includes a similar opening 34. A heart-shaped opening 37 could also be used to place hangers or items or for a bar to be placed between two such systems placed in proximity.

The tow bars 15 and handle 20 can be stored away within the luggage into a zipped compartment 42.

FIG. 4 shows a slightly alternative luggage system 52 embodiment. The only difference here is that the luggage 10 has a pair of telescoping tow bars 16 and the crown 4 is placed directly onto the tow bars, replacing the handle element of the previous embodiment. A pair of receivers 17 may be necessary to adapt the crown 4 to such an arrangement.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A decorative crown for a luggage system, the decorative crown comprising:

a rectangular base having a hollow bottom face configured for receiving a handle of a piece of luggage;

said hollow bottom face of said rectangular base further comprising a plurality of fins located on internal walls of said rectangular base;

said fins configured for gripping against said handle, thereby securing said rectangular base to said handle;

a first and second receiver located on opposite ends of a top face of said rectangular base, each configured for receiving hanger hooks; and a third receiver located in between said first and second receivers, said third receiver configured for receiving hanger hooks.

2. The decorative crown of claim 1, further comprising:

each of said first and second receivers comprising a circular shape;

each of said first and second receivers having a circular hole passing through them; and each said circular hole configured for receiving hanger hooks.

3. The decorative crown of claim 2, wherein each said circular hole further configured for receiving an end of a respective wardrobe bar.

4. The decorative crown of claim 1, further comprising:

said third receiver comprising a generally circular shape;

said third receiver having a hole passing through it; and said hole configured for receiving hanger hooks.

5. The decorative crown of claim 4, wherein each said receiver is further configured for receiving an end of a wardrobe bar.

6. The decorative crown of claim 4, wherein said hole has a curved top edge, a curve bottom edge, and two straight side edges.

7. The decorative crown of claim 1, further comprising a hole located within and passing through said rectangular base.

8. The decorative crown of claim 7, wherein said hole is heart shaped.

9. The decorative crown of claim 1, further comprising:

wherein said luggage comprises a stand configured for being moved between a first, stored position within said luggage and a second, extended position;

said handle connected to a pair of telescoping rods; and said stand configured for balancing said luggage when said handle is extended upon said telescoping rods, said decorative crown is placed atop said handle, and a garment is hung from at least one of said first, second, and third receivers.

10. A decorative crown for a luggage system, the decorative crown comprising:

a rectangular base having a hollow bottom face configured for receiving a handle of a piece of luggage;

a first and second receiver located on opposite ends of a top face of said rectangular base, each configured for receiving hanger hooks;

a third receiver located in between said first and second receivers, said third receiver configured for receiving hanger hooks;

each of said first, second, and third receivers having a respective hole passing through them;

wherein each of said receivers are further configured for receiving an end of a wardrobe bar;

each said hole configured for receiving hanger hooks;

said hollow bottom face of said rectangular base further comprising a plurality of fins located on internal walls of said rectangular base; and said fins configured for gripping against said handle, thereby securing said rectangular base to said handle.

11. A luggage system comprising:

a piece of luggage having a handle connected to a pair of telescoping rods, said handle configured for being telescoped from a first, stored position within said luggage to a second, extended position vertically extended above said luggage;

a stand configured for being moved between a first, stored position within said luggage and a second, extended position, said stand configured for balancing said luggage when said handle is extended to said second, extended position;

a decorative crown configured for being removably placed upon said handle when said handle is in said second, extended position;

said decorative crown comprising a rectangular base having a hollow bottom face configured for receiving said handle;

said decorative crown comprising a first and second receiver located on opposite ends of a top face of said rectangular base, each configured for receiving hanger hooks;

said decorative crown comprising a third receiver located in between said first and second receivers, said third receiver configured for receiving hanger hooks; and wherein each of said receivers are further configured for receiving an end of a wardrobe bar.

12. The luggage system of claim 11, further comprising:

each of said first and second receivers comprising a circular shape;

each of said first and second receivers having a circular hole passing through them; and each said circular hole configured for receiving hanger hooks.

13. The luggage system of claim 12, wherein each said circular hole further configured for receiving an end of a respective wardrobe bar.

14. The luggage system of claim 11, further comprising:

said third receiver comprising a generally circular shape;

said third receiver having a hole passing through it; and said hole configured for receiving hanger hooks.

15. The luggage system of claim 14, wherein each said receiver further configured for receiving an end of a wardrobe bar.

16. The luggage system of claim 14, wherein said hole has a curved top edge, a curve bottom edge, and two straight side edges.

17. The luggage system of claim 11, further comprising a hole located within and passing through said rectangular base.

18. The luggage system of claim 11, wherein said hole is heart shaped.

* * * * *